US010549418B1

(12) United States Patent
Cook

(10) Patent No.: US 10,549,418 B1
(45) Date of Patent: Feb. 4, 2020

(54) ADJUSTABLE SUPPORT DEVICE FOR ERGONOMICALLY SUPPORTING A WORKER FOR ACCESSING A LOWER WORK AREA

(71) Applicant: The Boeing Company, Chicago, IL (US)

(72) Inventor: Rebecca Leigh Cook, North Charleston, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/054,043

(22) Filed: Aug. 3, 2018

(51) Int. Cl.
*B25H 5/00* (2006.01)

(52) U.S. Cl.
CPC ..... *B25H 5/00* (2013.01)

(58) Field of Classification Search
CPC ..... B25H 5/00
See application file for complete search history.

(56) References Cited

U.S. PATENT DOCUMENTS 1,248,839 A * 12/1917 Fravel ..... B25H 5/00 280/32.6
2,487,706 A * 11/1949 Happ ..... B25H 5/00 280/32.6
2,498,313 A * 2/1950 Sweatt, Jr. ..... B25H 5/00 280/32.6
2,611,417 A * 9/1952 Henry ..... B25H 5/00 280/30
2,689,744 A * 9/1954 Mullin ..... B25H 5/00 280/32.6
2,780,472 A 2/1957 Weldon
2,787,009 A * 4/1957 Hagerty ..... B25H 5/00 5/640

(Continued)

FOREIGN PATENT DOCUMENTS

FR 2995810 A1 * 3/2014 ..... B25H 5/00
WO WO8809709 A * 12/1988

OTHER PUBLICATIONS

Pro Lift , "Mechanic Plastic Creeper", obtained on Jul. 3, 2018, pp. 1-3, obtained from internet: https://www.homedepot.com/p/Pro-Lift-Mechanic-Plastic-Creeper-40-in-Ergonomic-HDPE-Body-with-Padded-Headrest-Dual-Tool-Trays-350-lbs-Capacity-C-6040/303584999.

(Continued)

*Primary Examiner* — Jacob B Meyer
(74) *Attorney, Agent, or Firm* — Coats + Bennett, PLLC

(57) ABSTRACT

An adjustable support device for providing support to a worker oriented facedown thereon for accessing a lower work area disposed lower than the worker, such as one that the worker needs to extend out over in order to access appropriately. The adjustable support device includes a main support assembly and a leg support section pivotally coupled to the main support assembly. The leg support section may be pivoted to be angled upward. The main support assembly includes a midsection support and a chest support slidably mounted to the midsection support for movement along the longitudinal axis relative to the midsection support. A frame may be provided, and the midsection support may be angled upward relative to the frame. The adjustable support device provides ergonomic support to a worker so that the worker is supported over the lower work area in a cantilever fashion. Related methods are disclosed.

20 Claims, 16 Drawing Sheets

(56) References Cited

U.S. PATENT DOCUMENTS 2,942,693 A * 6/1960 Johnson ..... B25H 5/00 188/5
3,092,394 A * 6/1963 Burke ..... B25H 5/00 280/32.6
3,148,892 A * 9/1964 Merriott ..... B25H 5/00 280/32.6
4,057,240 A * 11/1977 Damico ..... A61G 13/0018 5/611
4,244,594 A * 1/1981 Hines ..... B25H 5/00 188/5
4,287,620 A * 9/1981 Zur ..... A61G 7/015 297/10
4,542,806 A * 9/1985 Olson ..... B25H 5/00 182/116
4,815,569 A * 3/1989 Norman ..... B25H 5/00 188/5
4,889,352 A * 12/1989 Chamberlin, Jr. ..... B25H 5/00 280/32.6
4,895,380 A * 1/1990 Brooks ..... B25H 5/00 280/32.6
4,925,197 A * 5/1990 Jones, Jr. ..... B25H 5/00 280/32.6
4,964,487 A * 10/1990 Webb ..... B25H 5/00 182/230
5,108,118 A * 4/1992 Schaevitz ..... B25H 5/00 280/32.6
5,160,185 A * 11/1992 Stang ..... A47D 13/08 297/377
5,195,763 A * 3/1993 Scott ..... B25H 5/00 280/32.6
5,330,211 A * 7/1994 Nicholson ..... B25H 5/00 280/32.6
D351,707 S * 10/1994 Pill ..... D34/12
5,472,219 A * 12/1995 Eckstrum ..... B25H 5/00 188/5
5,494,305 A * 2/1996 Chen ..... B25H 5/00 280/32.6
5,611,552 A * 3/1997 Miles ..... B25H 5/00 280/32.5
5,707,067 A * 1/1998 Smith ..... B25H 5/00 280/32.6
5,829,077 A * 11/1998 Neige ..... A47C 20/041 5/618
5,895,062 A * 4/1999 Miles ..... B25H 5/00 280/32.6
5,899,297 A * 5/1999 Clark ..... B25H 5/00 182/222
5,947,489 A * 9/1999 Tucker ..... B25H 5/00 280/32.6
6,076,838 A * 6/2000 Peterson ..... B25H 5/00 188/5
6,095,532 A * 8/2000 Martin ..... B25H 5/00 280/30
RE37,372 E * 9/2001 Smith ..... B25H 5/00 280/32.6
6,425,590 B1 * 7/2002 Whiteside ..... B25H 5/00 280/32.5
6,578,857 B1 * 6/2003 Whiteside ..... B25H 5/00 280/32.5
6,641,146 B2 * 11/2003 Reese ..... B25H 5/00 182/116
6,702,305 B2 * 3/2004 Miles ..... B25H 5/00 280/32.5
6,824,149 B1 * 11/2004 Whitlock ..... B25H 5/00 280/32.6
6,834,868 B1 * 12/2004 Blackburn ..... B25H 5/00 280/32.6
6,871,861 B2 * 3/2005 Hernandez, Jr. ..... B25H 5/00 248/129
6,966,564 B2 * 11/2005 Hernandez, Jr. ..... B25H 5/00 248/129
6,969,077 B2 * 11/2005 Liu ..... B25H 5/00 280/30
7,025,421 B1 * 4/2006 Fowler ..... A47C 1/026 297/325
7,032,907 B1 * 4/2006 Marsh ..... B25H 5/00 280/32.5
7,032,908 B2 * 4/2006 Melvin ..... B25H 5/00 280/32.6
7,070,189 B2 * 7/2006 Grauss ..... B25H 5/00 108/147
7,257,850 B1 * 8/2007 Tekulve ..... A47C 20/041 5/428
7,363,864 B2 * 4/2008 Broek ..... B25H 5/00 104/106
7,367,570 B1 * 5/2008 Marsh ..... B25H 5/00 280/32.5
7,374,181 B1 * 5/2008 Wu ..... B25H 5/00 280/32.5
7,434,817 B2 * 10/2008 Rush ..... B25H 5/00 280/32.5
7,478,818 B1 * 1/2009 Whiteside ..... B25H 5/00 280/32.5
7,481,438 B2 * 1/2009 Hernandez ..... B25H 5/00 280/32.5
7,743,710 B2 * 6/2010 Gordon ..... B25H 5/00 104/2
8,573,607 B2 * 11/2013 Meacham ..... B25H 5/00 104/97
9,022,198 B2 * 5/2015 Lykkegaard ..... B65G 17/12 104/279
9,061,413 B2 * 6/2015 Huang ..... B60Q 1/24
9,095,972 B2 * 8/2015 Meacham ..... B25H 5/00
9,126,325 B1 * 9/2015 Meacham ..... B25H 5/00
9,126,326 B1 * 9/2015 Bowen ..... B25H 5/00
9,193,064 B2 * 11/2015 Dall'Armi ..... B25H 5/00
9,242,369 B1 * 1/2016 Richmond, Jr. ..... B25H 5/00
9,339,928 B1 * 5/2016 Obitts ..... B25H 5/00
9,486,914 B1 11/2016 Frolander
9,610,682 B2 * 4/2017 Shaner ..... B25H 5/00
9,623,551 B1 * 4/2017 Bowen ..... A47C 1/00
9,925,659 B1 * 3/2018 Clemmer ..... B25H 5/00
9,962,307 B2 * 5/2018 Brinkerhoff ..... A61G 15/00
10,029,362 B2 * 7/2018 Fuentes ..... B25H 5/00
10,232,504 B1 * 3/2019 Whiteside ..... B25H 5/00
10,328,570 B1 * 6/2019 O'Donnell ..... B25H 5/00
2001/0020773 A1 * 9/2001 Whiteside ..... B25H 5/00 280/32.6
2002/0060437 A1 * 5/2002 Whiteside ..... B25H 5/00 280/32.6
2003/0168824 A1 * 9/2003 Miles ..... B25H 5/00 280/32.6
2004/0066020 A1 * 4/2004 Hernandez, Jr. ..... B25H 5/00 280/639
2004/0148704 A1 * 8/2004 Tekulve ..... A47C 20/041 5/618
2004/0227313 A1 * 11/2004 Shockley ..... B25H 5/00 280/32.6
2005/0023780 A1 * 2/2005 Liu ..... B25H 5/00 280/32.6
2005/0051048 A1 * 3/2005 Broek ..... B25H 5/00 104/106
2005/0051980 A1 * 3/2005 Melvin ..... B25H 5/00 280/32.6
2005/0098967 A1 * 5/2005 Hernandez, Jr. ..... B25H 5/00 280/32.6
2006/0192355 A1 * 8/2006 Hulden ..... B25H 5/00 280/32.6
2007/0013154 A1 * 1/2007 Staples ..... B25H 5/00 280/32.6
2007/0241523 A1 * 10/2007 Lewman ..... B25H 5/00 280/32.5
2008/0012252 A1 * 1/2008 Hernandez ..... B25H 5/00 280/32.6
2008/0093810 A1 * 4/2008 Liu ..... B25H 5/00 280/32.6

(56) References Cited

U.S. PATENT DOCUMENTS

2008/0136129 A1* 6/2008 Wu ..... B25H 5/00 280/32.6
2008/0157492 A1* 7/2008 Chaykin ..... A47C 13/00 280/32.6
2008/0250562 A1* 10/2008 Tekulve ..... A47C 20/041 5/613
2009/0095190 A1* 4/2009 Gordon ..... A63G 7/00 104/53
2009/0115150 A1* 5/2009 Hernandez ..... B25H 5/00 280/32.6
2011/0049822 A1 3/2011 Hinman
2011/0227302 A1* 9/2011 Gillespie ..... B25H 5/00 280/32.6
2011/0227303 A1* 9/2011 Gering ..... B25H 1/04 280/32.6
2012/0049471 A1* 3/2012 Meacham ..... B25H 5/00 280/32.6
2012/0091673 A1* 4/2012 Meacham ..... B25H 5/00 280/32.6
2012/0169019 A1* 7/2012 Grossberger ..... B62K 3/005 280/32.5
2012/0235371 A1* 9/2012 Smith ..... B25H 5/00 280/32.6
2013/0126297 A1* 5/2013 Lykkegaard ..... B25H 5/00 198/322
2014/0339783 A1* 11/2014 Dall'Armi ..... B25H 5/00 280/32.6
2015/0084293 A1* 3/2015 Huang ..... B25H 5/00 280/32.6
2016/0039088 A1* 2/2016 Blasjo ..... B25H 5/00 280/32.6
2016/0151220 A1* 6/2016 Hinton ..... A61G 13/02 5/600
2016/0151906 A1* 6/2016 Chromik ..... B25H 5/00 2/93
2016/0263741 A1* 9/2016 Shaner ..... B25H 5/00
2017/0049651 A1* 2/2017 Lim ..... A61G 13/02
2017/0099954 A1* 4/2017 Chao ..... A47C 9/027
2018/0319007 A1* 11/2018 Wilkinson ..... B66F 11/04
2019/0021505 A1* 1/2019 Chrestman ..... A47C 9/027
2019/0021510 A1* 1/2019 Gao ..... A61G 7/018
2019/0061141 A1* 2/2019 Whiteside ..... B25H 5/00
2019/0175431 A1* 6/2019 Clayton ..... A61G 13/02
2019/0210214 A1* 7/2019 Shrock ..... B25H 5/00

OTHER PUBLICATIONS

SGS, "Folding Headrest Professional Mechanics Car Creeper", obtained on Jul. 3, 2018, pp. 1-10, obtained from internet: https://www.sgs-engineering.com/c3000-car-inspection-creeper.

* cited by examiner

ADJUSTABLE SUPPORT DEVICE FOR ERGONOMICALLY SUPPORTING A WORKER FOR ACCESSING A LOWER WORK AREA

TECHNOLOGICAL FIELD

The present disclosure relates generally to manufacturing and/or maintenance tools and processes. More specifically, the present disclosure relates to an adjustable support for providing ergonomic support to a worker oriented facedown thereon for accessing a work area disposed lower than the worker, such as one that the worker needs to extend out over in order to access appropriately, and related methods.

BACKGROUND

In many manufacturing and/or maintenance situations, a worker needs to access a work zone in order to perform a task, such as assembly, installation or replacement of a component, inspection, etc. For situations where the work zone is relatively open, access is readily achieved. Likewise, in situations where the work zone is above the worker, the worker may simply reach up from a standing position, or may lie on their back (e.g., on a creeper) and reach up, to access the work zone and carry out the task. However, when the work zone is disposed lower than the worker, and particularly when nearby structures create obstructions, the worker may need to extend themselves out over the work zone and reach down into the work zone in order to perform the task. Existing solutions include having the worker kneel or squat down next to the work zone, or having the worker lay down near the work zone and reach out over the work zone. Unfortunately, both of these solutions may be less than ideal from an ergonomic perspective, and may put strain on the worker's body, potentially leading to increased fatigue and other issues, particularly if the worker is required to support and/or manipulate a tool or tools when extended out over the work zone.

Accordingly, there is a need for alternative approaches to providing support to a worker for accessing a work area disposed lower than the worker. Such approaches should advantageously be adjustable to accommodate various size workers and/or various work environments, and should advantageously provide good ergonomic support.

SUMMARY

Aspects of the present disclosure are directed to an adjustable support device for providing support to a worker oriented facedown thereon for accessing a lower work area disposed lower than the worker, such as one that the worker needs to extend out over in order to access appropriately. Further aspects of the present disclosure are directed to a method of supporting a worker for accessing a work area disposed lower than the worker, and/or a method of manufacturing or servicing an aircraft, using the adjustable support device.

In one or more aspects, the adjustable support device includes a main support assembly and a leg support section. The main support assembly has a longitudinal axis and a lateral axis. The main support assembly includes a midsection support and a chest support slidably mounted to the midsection support for movement along the longitudinal axis relative to the midsection support. The chest support is laterally narrower than the midsection support. The leg support section is pivotally coupled to the main support assembly for rotation about a first pivot axis disposed parallel to the lateral axis. The adjustable support device is movable between a first configuration, a second configuration, and a third configuration. In the first configuration: 1) the leg support section, the midsection support, and the chest support are disposed parallel to each other; and 2) the chest support is retracted toward the midsection support. In the second configuration: 1) the leg support section is rotated about the first pivot axis such that the leg support section is angled upward relative to the midsection support; and 2) the chest support is retracted toward the midsection support. In the third configuration: 1) the leg support section is rotated about the first pivot axis such that the leg support section is angled upward relative to the midsection support; and 2) the chest support is extended away from the midsection support along the longitudinal axis. The adjustable support device optionally further includes a frame configured to support the main support assembly and the leg support section, with the leg support section pivotally mounted to the frame and the frame interconnecting the leg support section to the main support assembly. In the third configuration, the chest support is disposed distally beyond the frame when the frame is present.

In one or more other aspects, the present disclosure is directed to a method of supporting a worker for accessing a lower work area disposed lower than the worker. The method includes disposing an adjustable support device on a higher surface of the work area, near a lower work area. The adjustable support device includes a main support assembly and a leg support section. The main support assembly has a longitudinal axis and a lateral axis. The main support assembly includes a midsection support and a chest support slidably mounted to the midsection support for movement along the longitudinal axis relative to the midsection support. The chest support is laterally narrower than the midsection support. The leg support section is pivotally coupled to the main support assembly for rotation about a first pivot axis disposed parallel to the lateral axis. The method continues with changing the adjustable support device from a first configuration to a second configuration. In the first configuration: 1) the leg support section, the midsection support, and the chest support are disposed parallel to each other; and 2) the chest support is retracted toward the midsection support. In the second configuration: 1) the leg support section is rotated about the first pivot axis such that the leg support section is angled upward relative to the midsection support; and 2) the chest support is retracted toward the midsection support. The method continues with positioning the worker on the adjustable support device in a facedown orientation, such that: 1) the worker extends out over the lower work area; 2) the worker's lower leg is supported by the leg support section such that the worker's feet hang downward; 3) the worker's midsection is supported by the midsection support; 5) the worker's chest is supported by the chest support; and 5) a shoulder (or both) of the worker is disposed laterally outboard of the chest support.

In one or more other aspects, the present disclosure is directed to a method of manufacturing or servicing an aircraft. The method includes positioning an adjustable support device on a higher surface of the work area, near a lower work area. The adjustable support device includes a main support assembly and a leg support section. The main support assembly has a longitudinal axis and a lateral axis. The main support assembly includes a midsection support and a chest support slidably mounted to the midsection support for movement along the longitudinal axis relative to the midsection support. The chest support is laterally narrower than the midsection support. The leg support section is pivotally coupled to the main support assembly for rotation about a first pivot axis disposed parallel to the lateral axis. The method continues with changing the adjustable support device from a first configuration to a second configuration. In the first configuration: 1) the leg support section, the midsection support, and the chest support are disposed parallel to each other; and 2) the chest support is retracted toward the midsection support. In the second configuration: 1) the leg support section is rotated about the first pivot axis such that the leg support section is angled upward relative to the midsection support; and 2) the chest support is retracted toward the midsection support. The method continues with a worker performing a task in the lower work area while the worker is supported on the adjustable support device in a facedown orientation, such that: 1) the worker extends out over the lower work area; 2) the worker's lower leg is supported by the leg support section such that the worker's feet hang downward; 3) the worker's midsection is supported by the midsection support; and 4) the worker's chest is supported by the chest support; and 5) a shoulder (or both) of the worker is disposed laterally outboard of the chest support. The task is at least one of: installing a component of the aircraft in the lower work area; removing a component of the aircraft from the lower work area; replacing a component of the aircraft in the lower work area; inspecting a component of the aircraft disposed in the lower work area; and/or drilling and/or reaming in the lower work area.

The features, functions and advantages that have been discussed can be achieved independently in various aspects or may be combined in yet other aspects further details of which can be seen with reference to the following description and the drawings.

BRIEF DESCRIPTION OF THE DRAWINGS

Having thus described variations of the disclosure in general terms, reference will now be made to the accompanying drawings, which are not necessarily drawn to scale.

Figure 1:
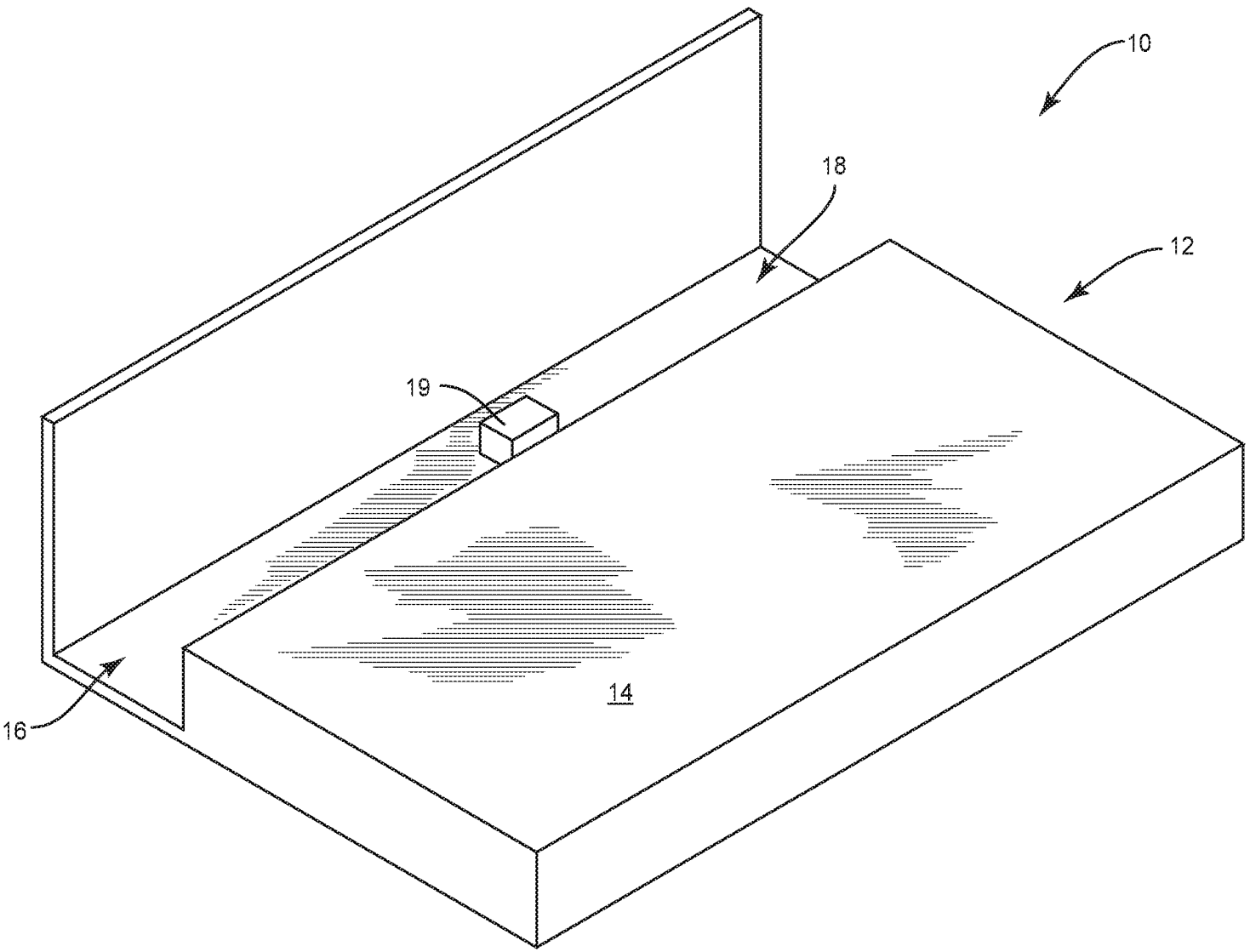

FIG. 1 shows a perspective view of an exemplary work area.

Figure 2:
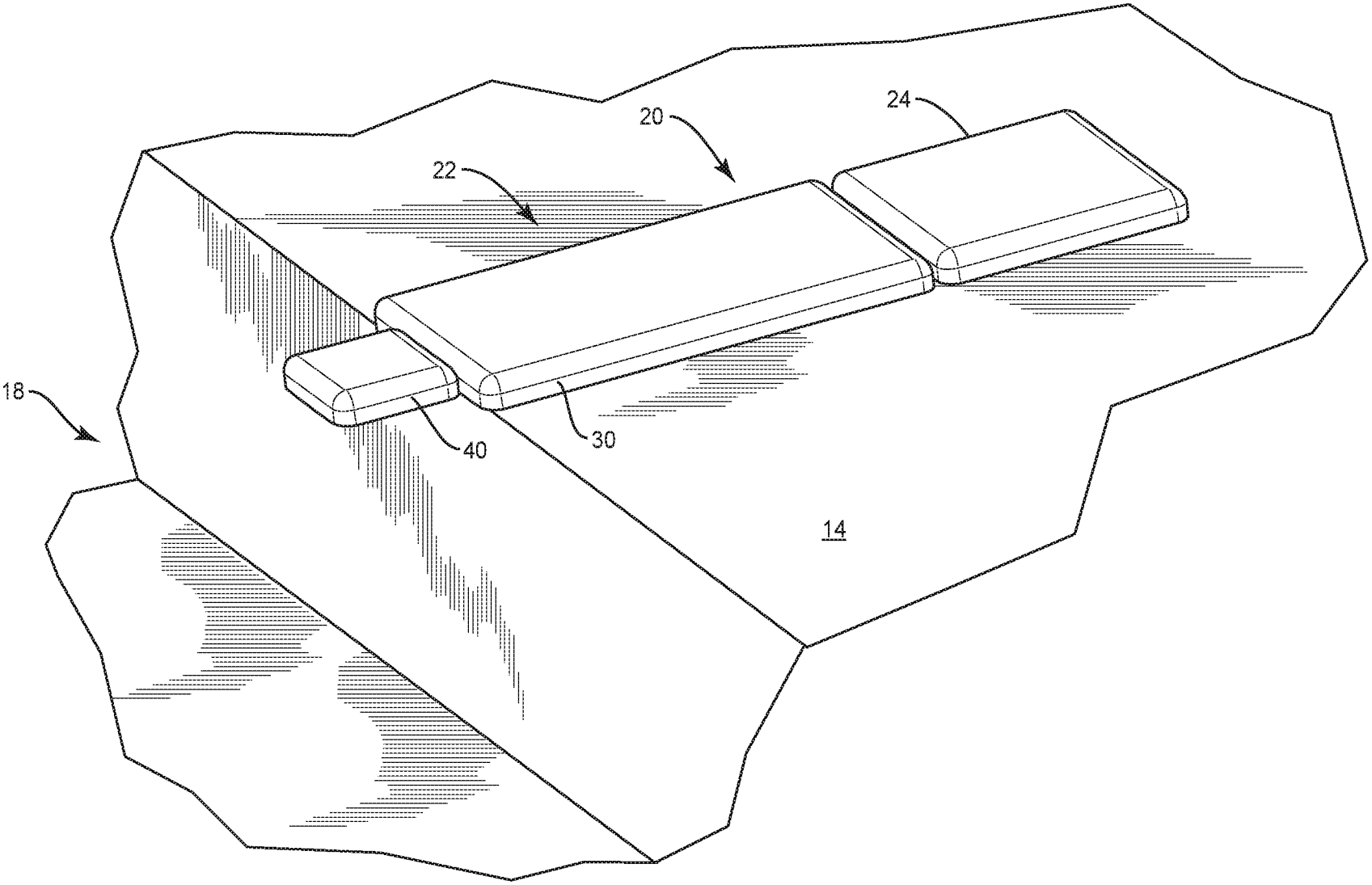

FIG. 2 shows a perspective view of an exemplary adjustable support device according to aspects of the present disclosure disposed in the work area of FIG. 1.

Figure 3:
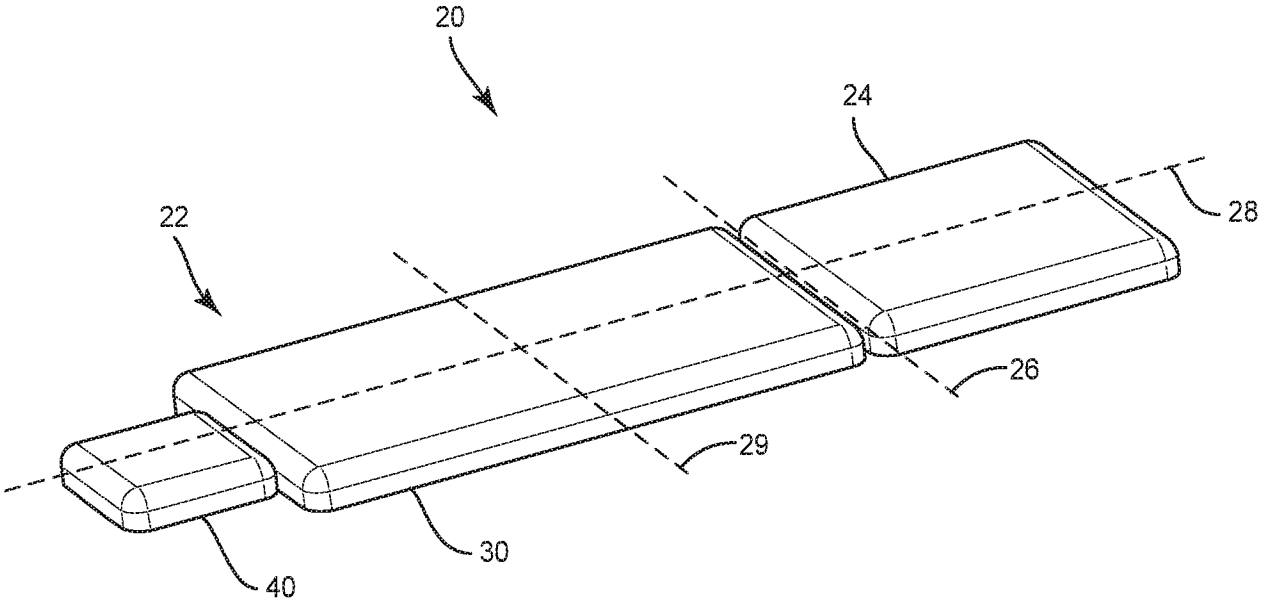

FIG. 3 shows a perspective view of the adjustable support device of FIG. 2 in a first (collapsed) configuration.

Figure 4:
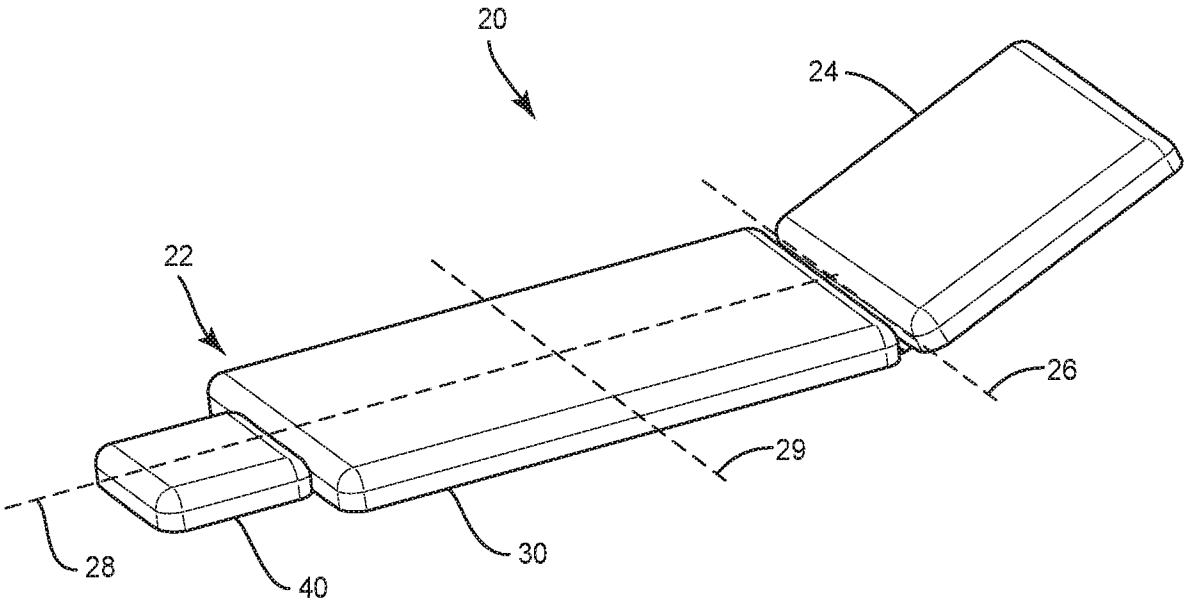

FIG. 4 shows a perspective view of the adjustable support device of FIG. 2 in a second configuration.

Figure 5:
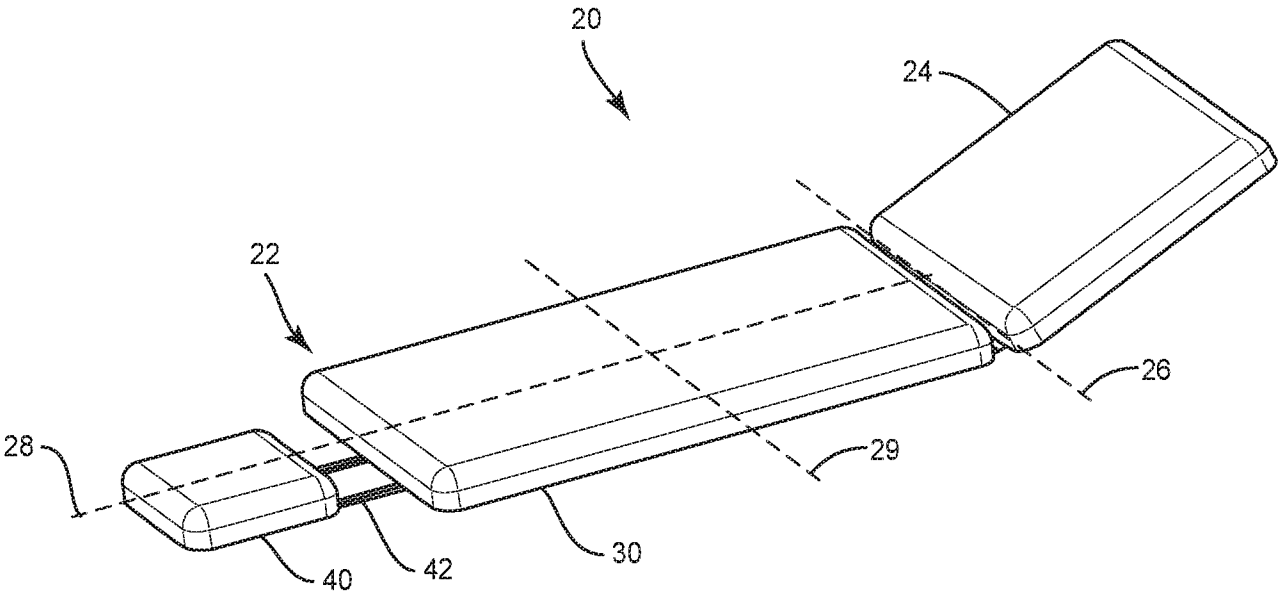

FIG. 5 shows a perspective view of the adjustable support device of FIG. 2 in a third configuration.

Figure 6:
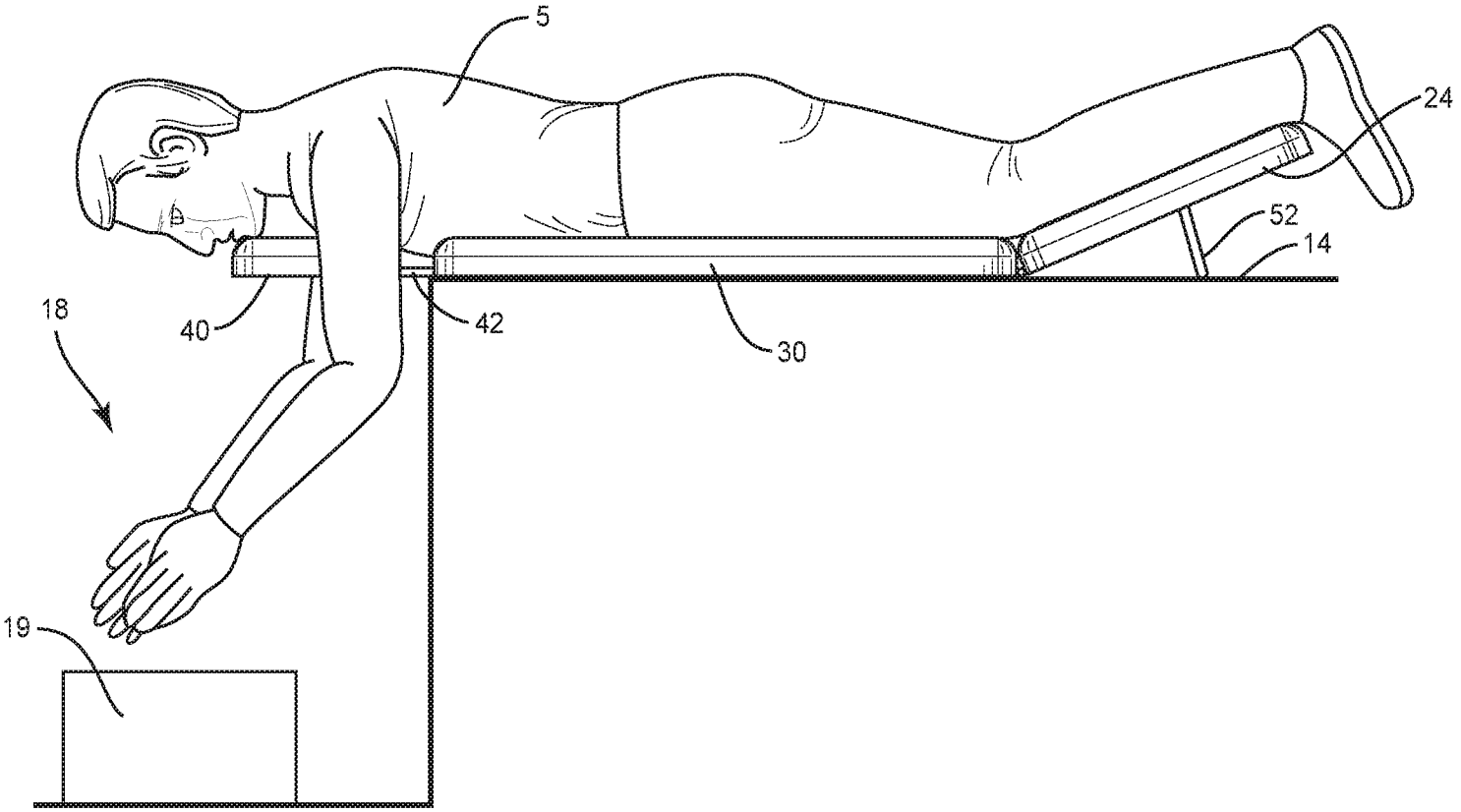

FIG. 6 shows a side view of a worker supported by the adjustable support device of FIG. 2, performing a task.

Figure 7:
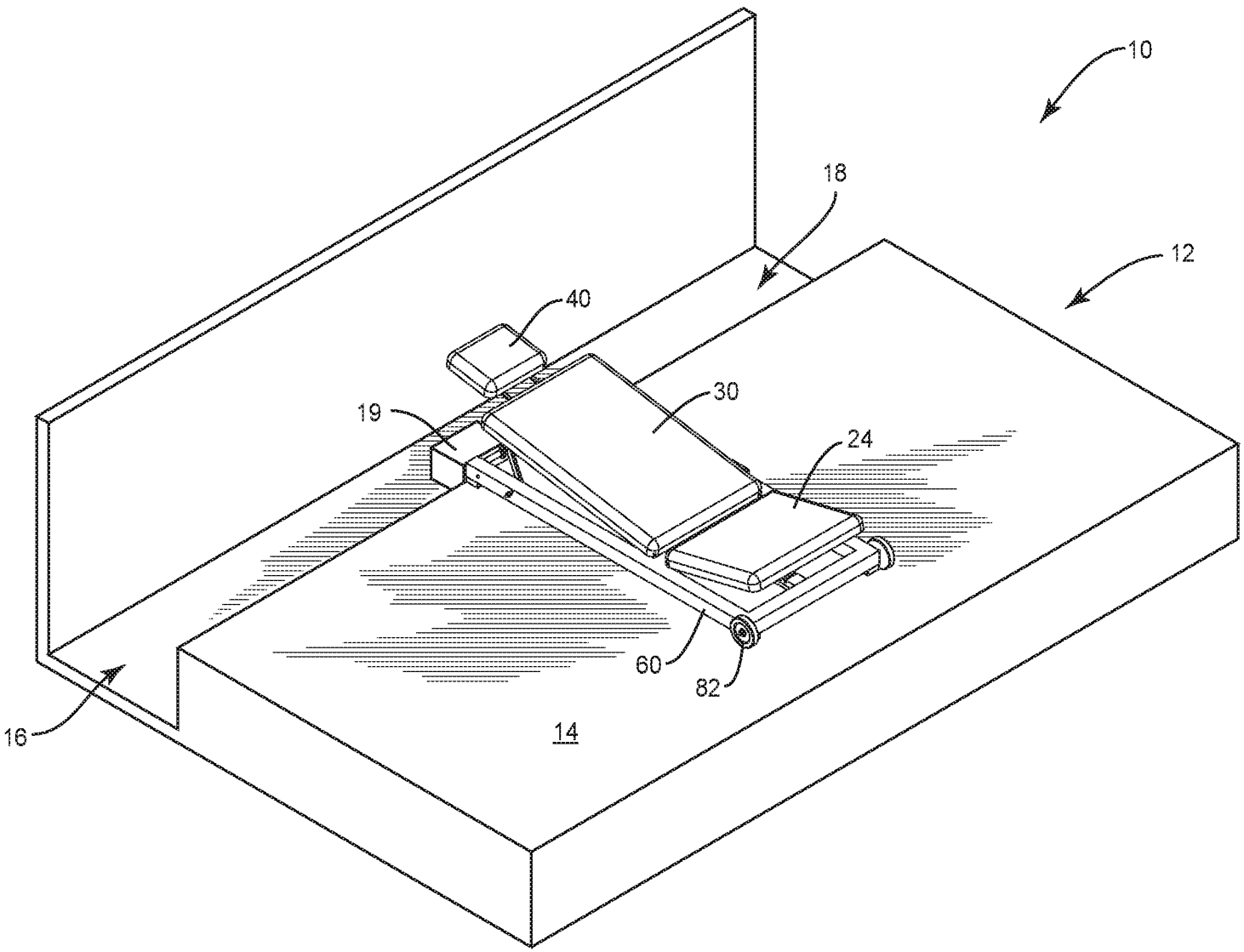

FIG. 7 shows a perspective view of another exemplary adjustable support device according to aspects of the present disclosure disposed on the higher surface of the work area of FIG. 1.

Figure 8:
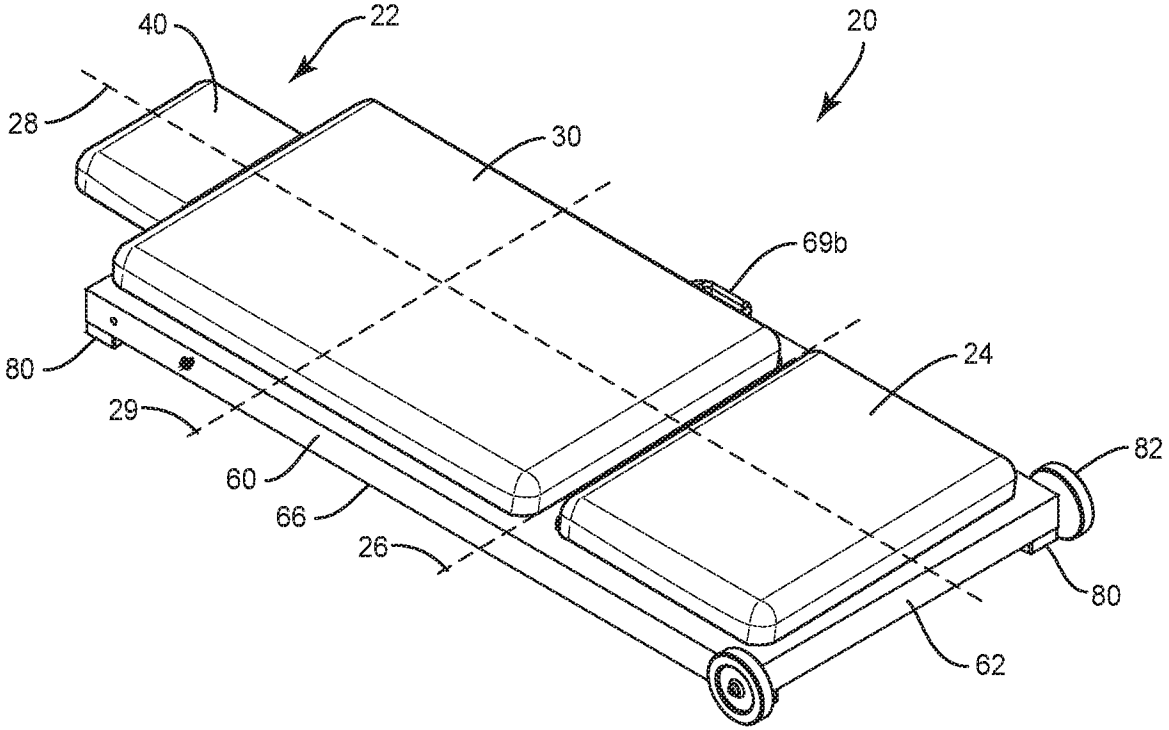

FIG. 8 shows a perspective view of the adjustable support device of FIG. 7 in a first (collapsed) configuration.

Figure 9:
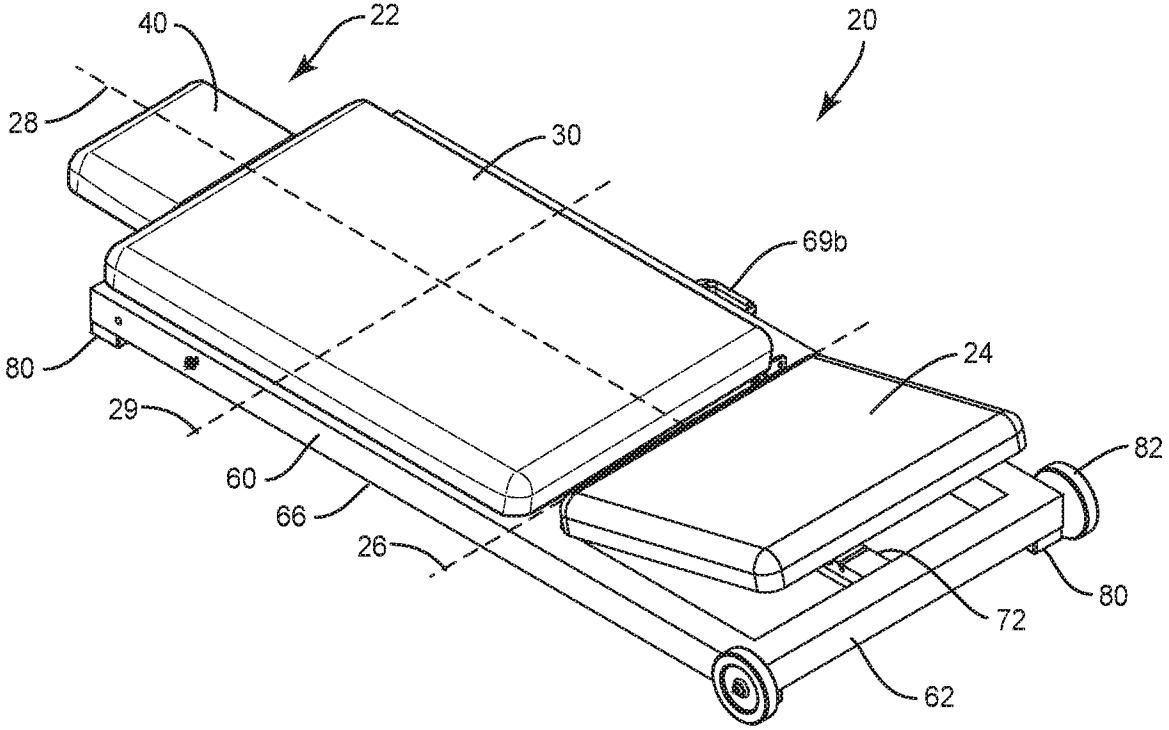

FIG. 9 shows a perspective view of the adjustable support device of FIG. 7 in a second configuration.

Figure 10:
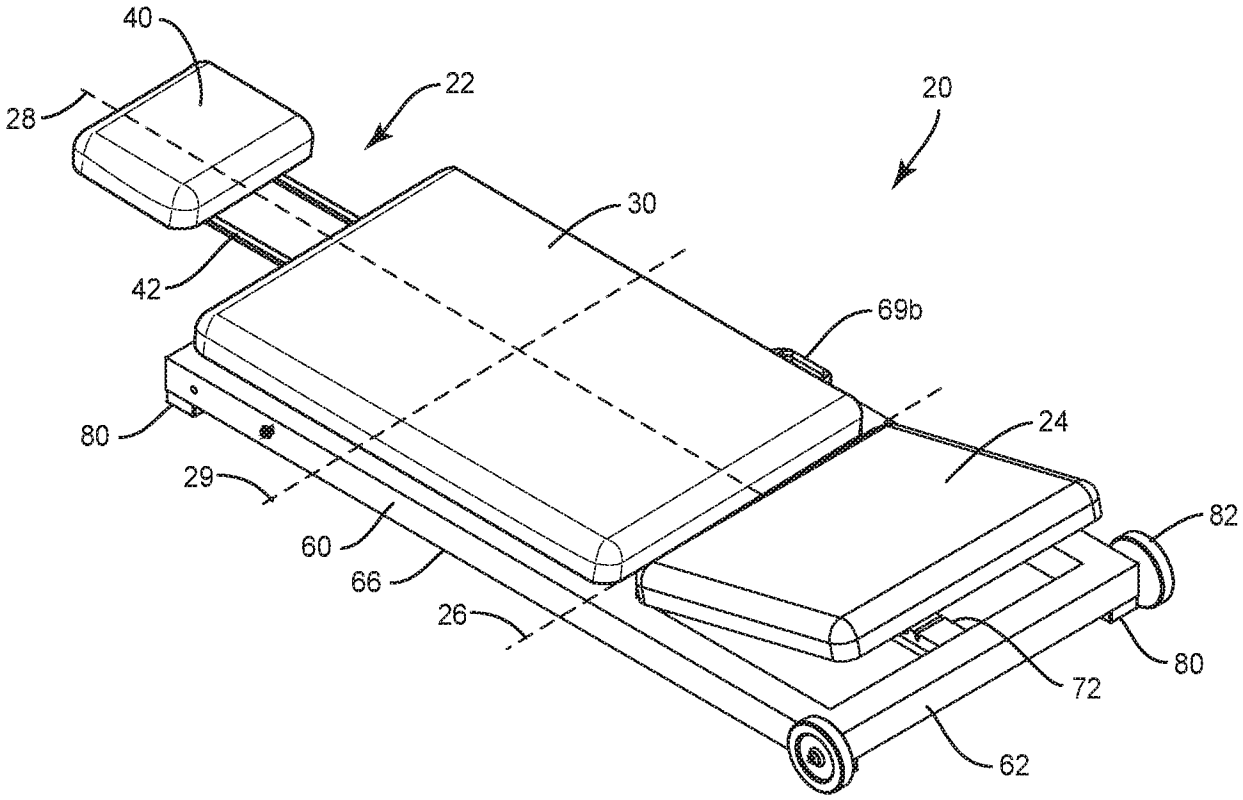

FIG. 10 shows a perspective view of the adjustable support device of FIG. 7 in a third configuration.

Figure 11:
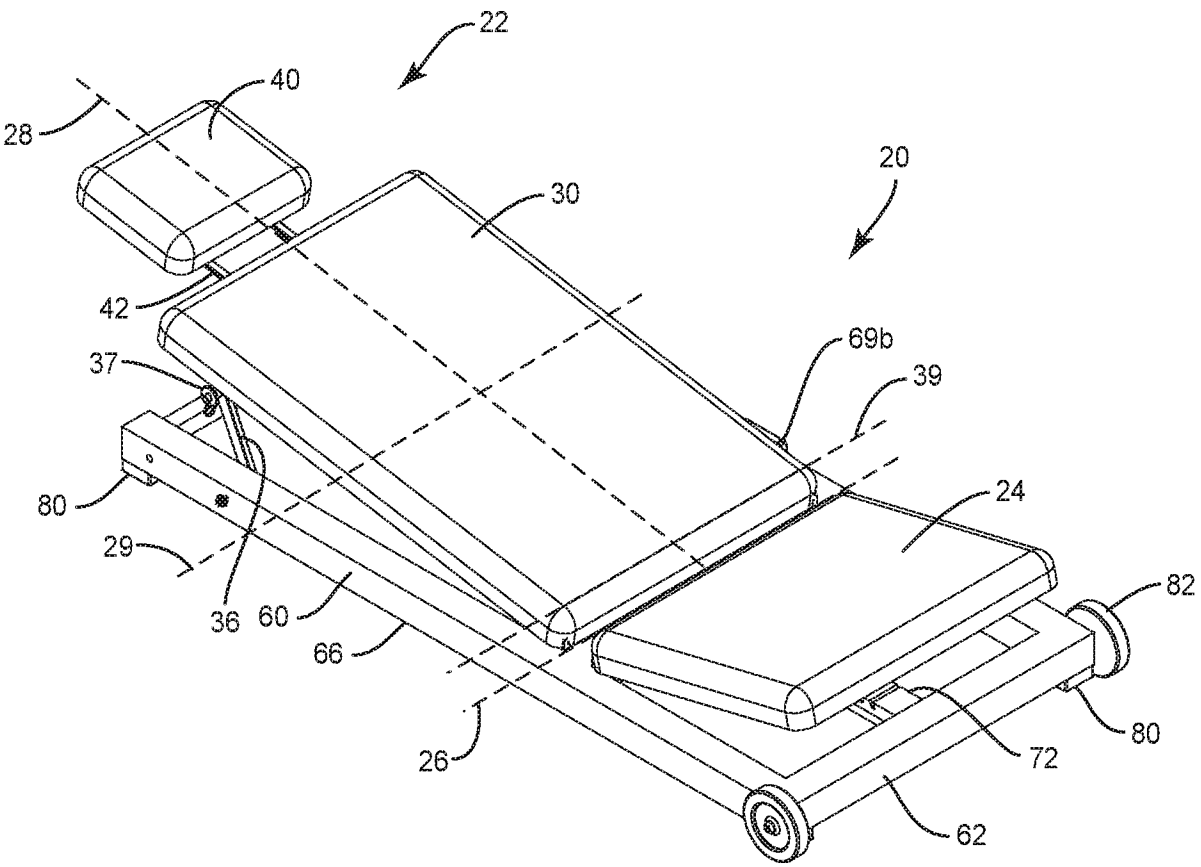

FIG. 11 shows a perspective view of the adjustable support device of FIG. 7 in a fourth configuration.

Figure 12:
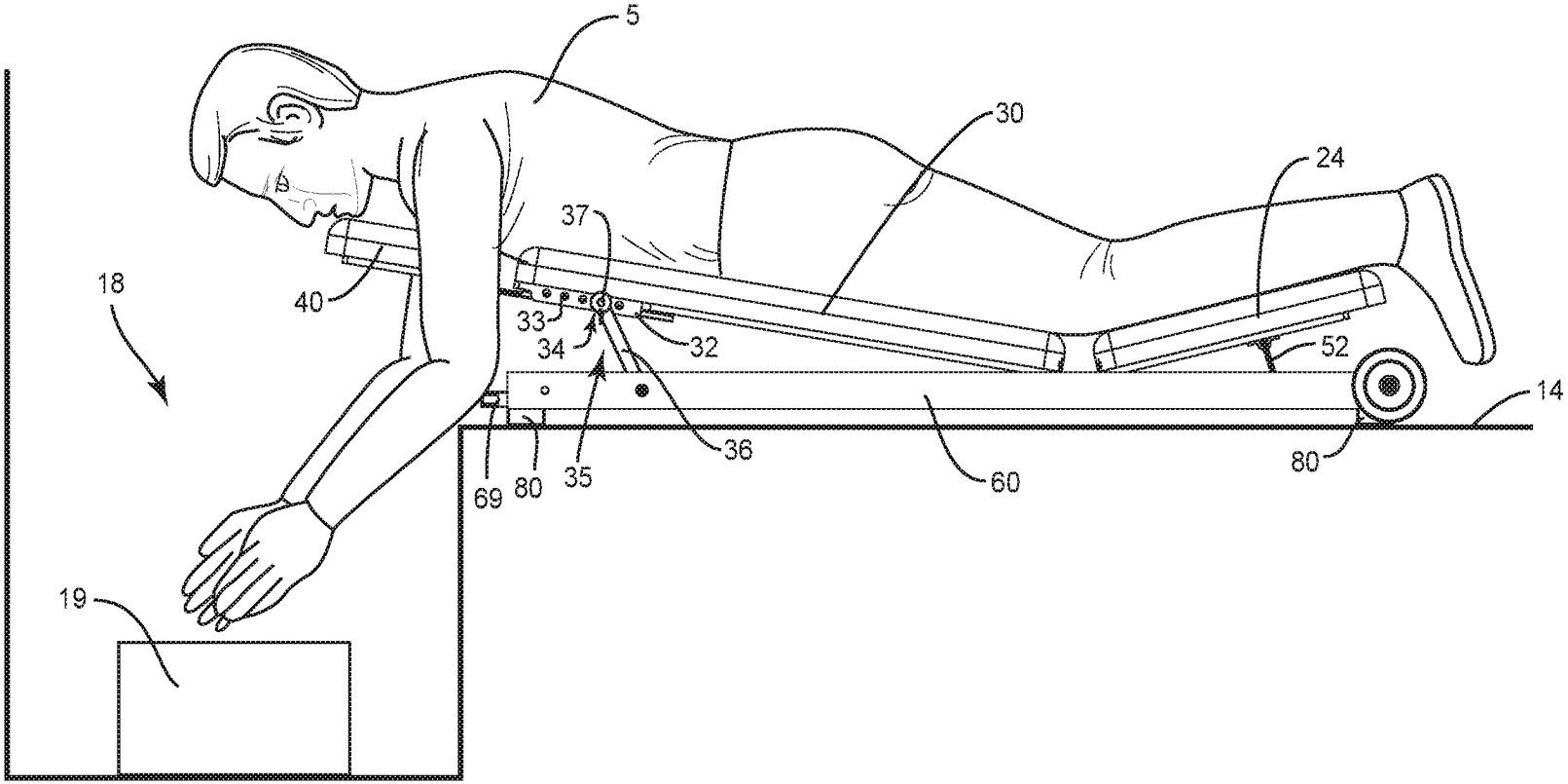

FIG. 12 shows a side view of a worker supported by the adjustable support device of FIG. 7, performing a task.

Figure 13:
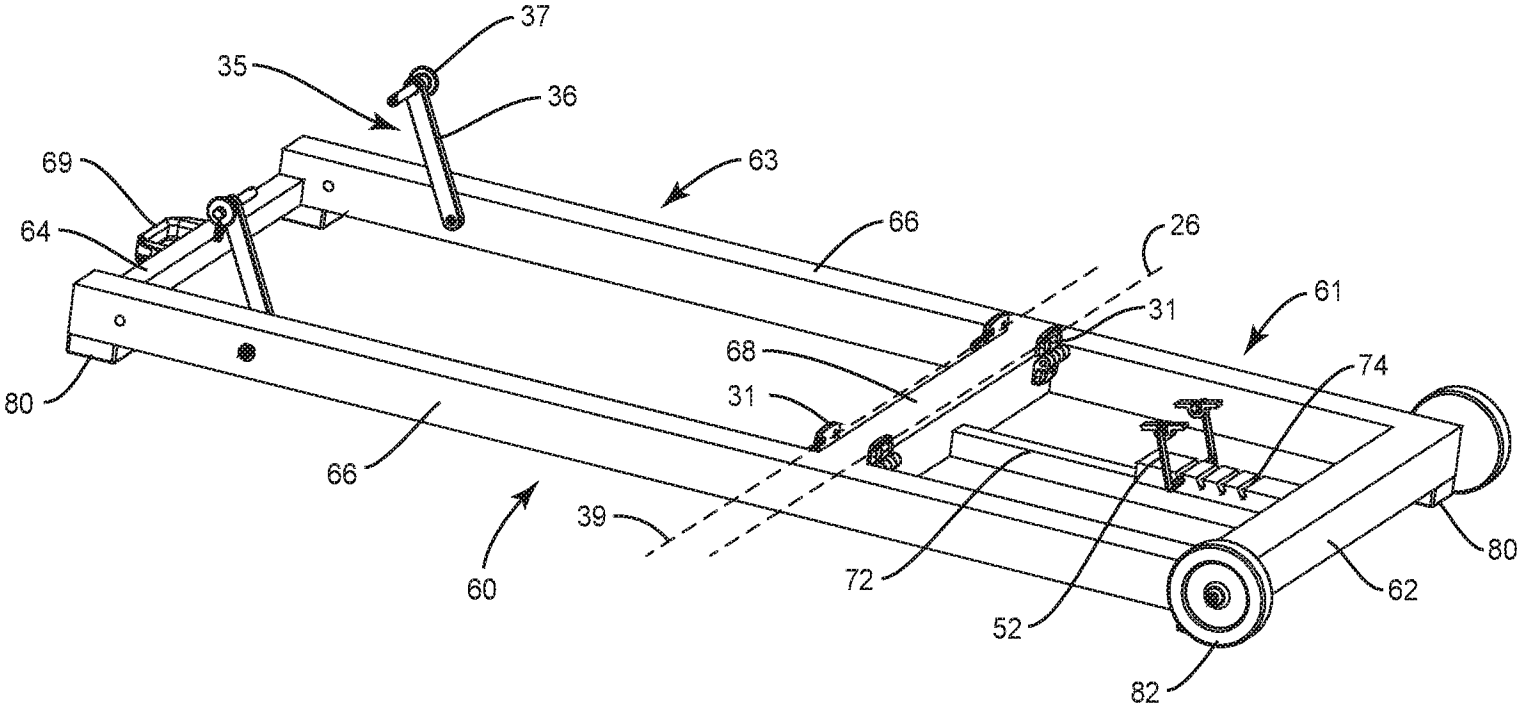

FIG. 13 shows a frame of the adjustable support device of FIG. 7.

Figure 14:
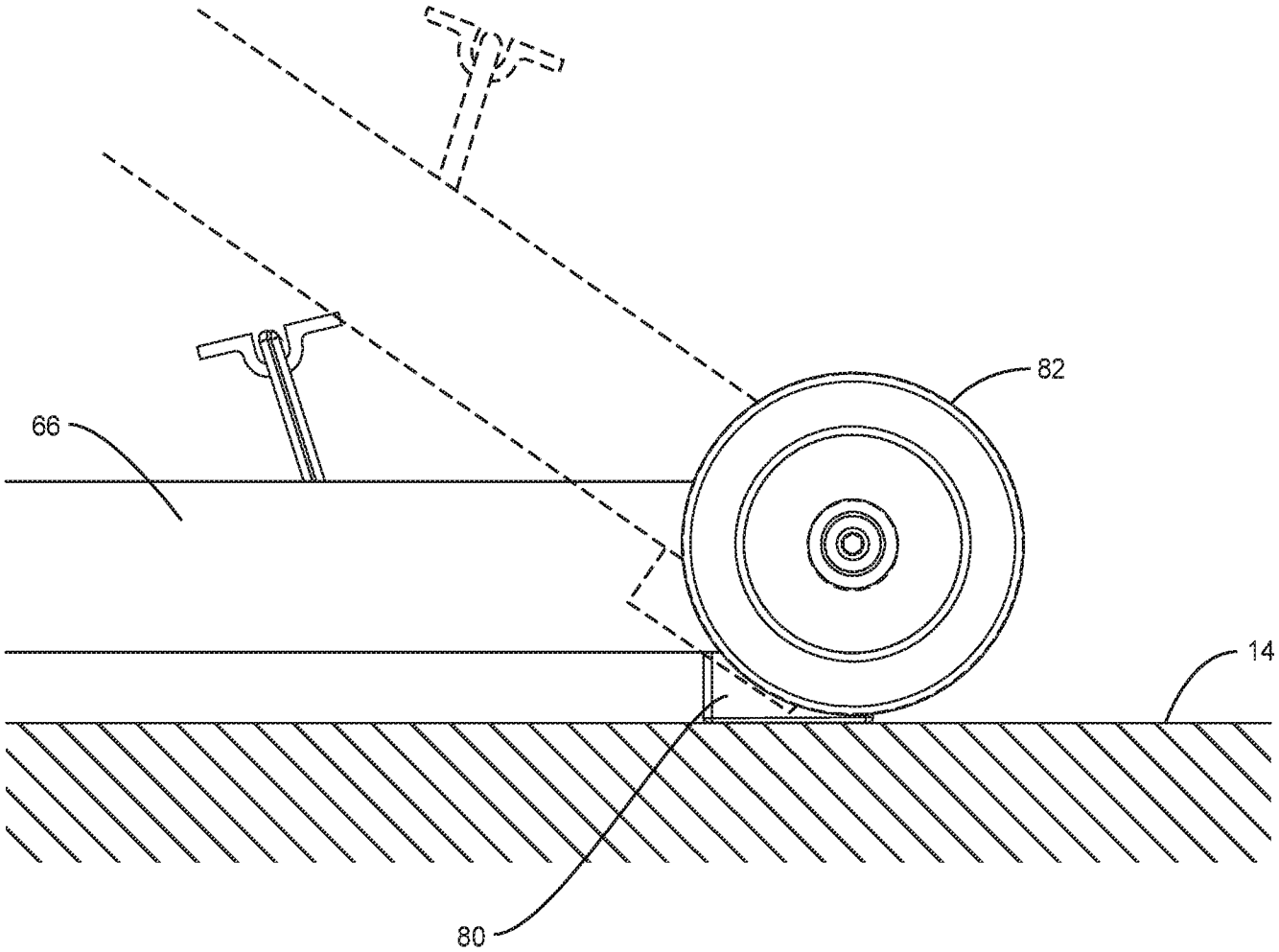

FIG. 14 shows a detail view of the adjustable support device of FIG. 7 when disposed on the higher surface of the work area of FIG. 1.

Figure 15:
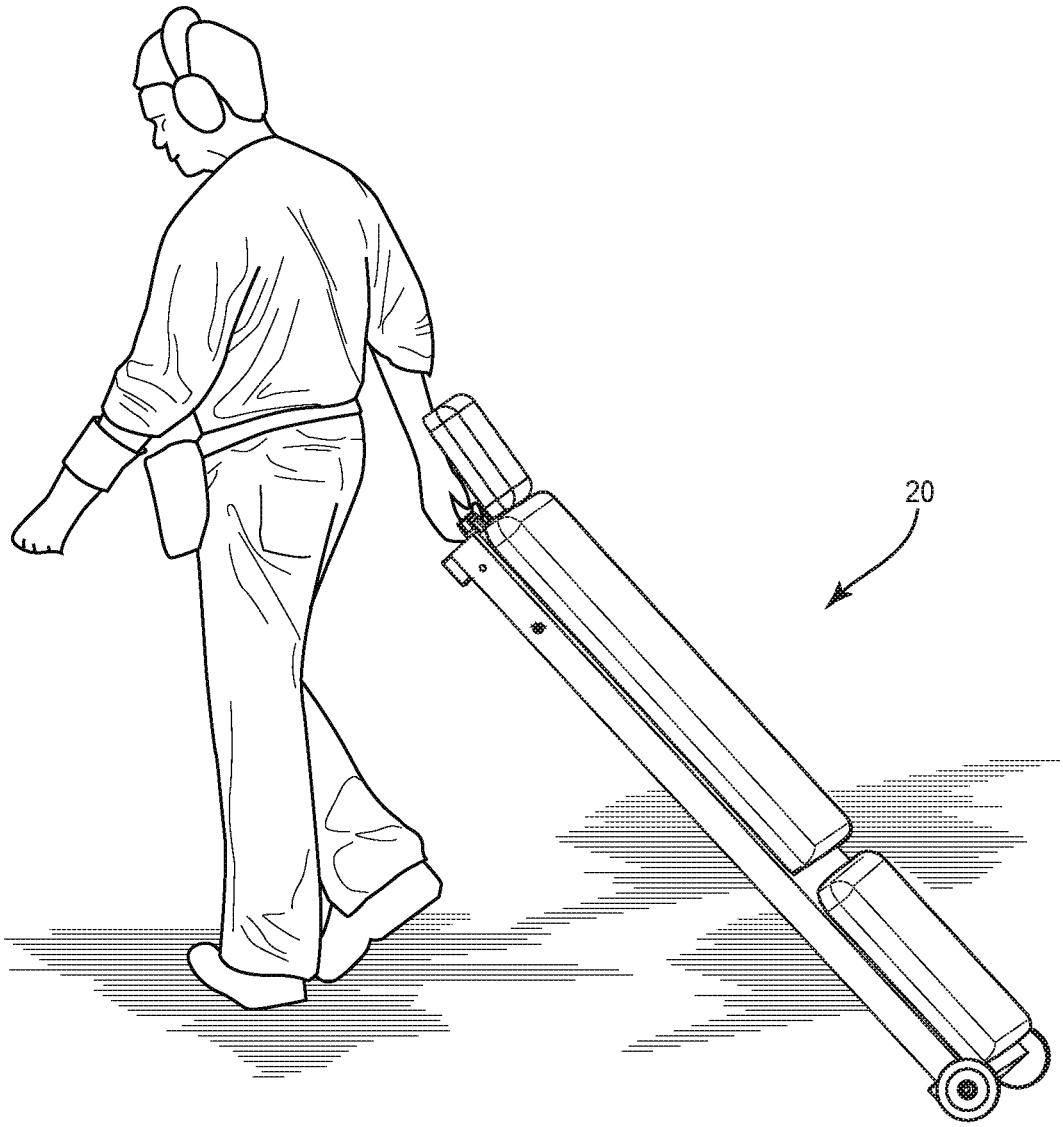

FIG. 15 shows the adjustable support device of FIG. 7 in the first configuration being transported by being rolled across a surface.

Figure 16:
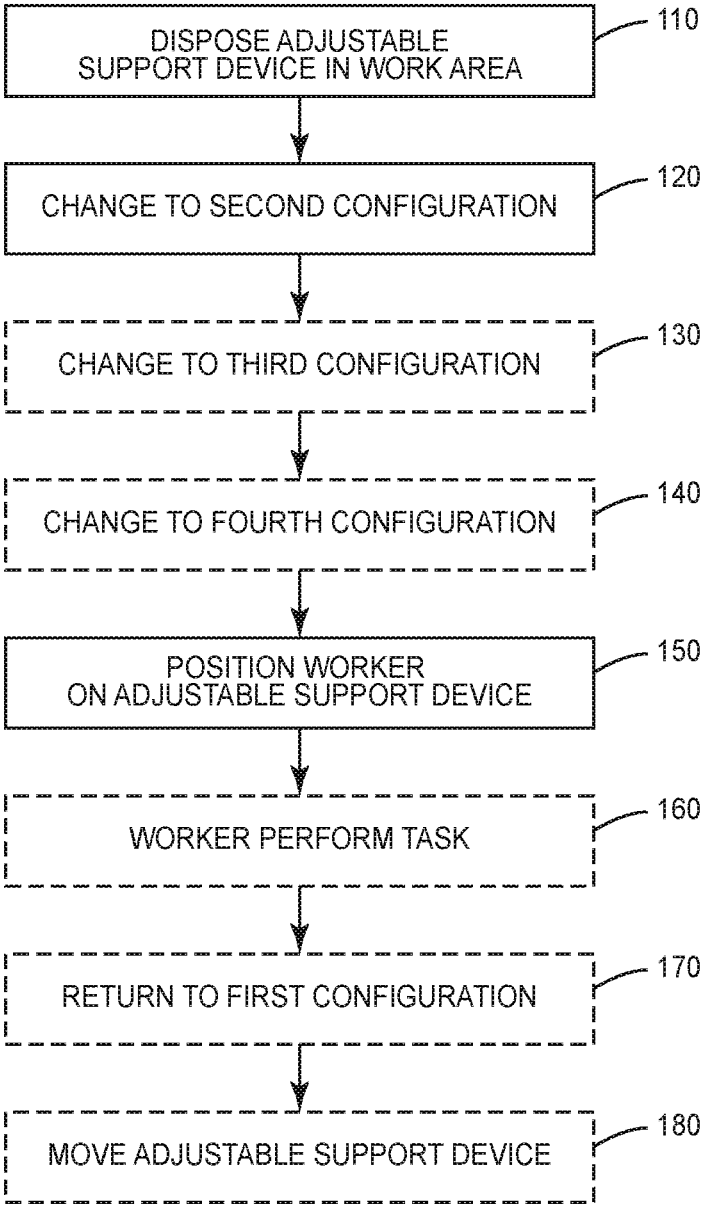

FIG. 16 shows a flowchart pertaining to aspects of the present disclosure.

DETAILED DESCRIPTION

Aspects of the present disclosure are directed to an adjustable support device for providing support to a worker 5 oriented facedown thereon for accessing a lower work area 18 disposed lower than the worker 5, and to related methods. Referring to FIG. 1, an exemplary work area 10 is shown. In some aspects, the work area 10 is a portion of an aircraft or other vehicle, or a portion of a building such as a factory, or a portion of other work environments. As shown in FIG. 1, the work area 10 includes a higher zone 12 and a lower zone 16. The higher zone 12 includes a higher surface 14. The lower zone 16 includes a lower work area 18, and is disposed at a vertically lower height than the higher zone 12. In some aspects, one or more components 19 are disposed in the lower work area 18. While the lower work area 18 is depicted in FIG. 1 as a linear trough for simplicity, the lower work area 18 is not restricted to such a shape, and may take any suitable form.

Referring to FIGS. 2-6, the adjustable support device 20 of one or more aspects is intended for use in the work area 10. For example, the adjustable support device 20 is positioned to provide ergonomic support to a worker 5 oriented facedown thereon, so that the worker 5 is supported in a cantilever fashion over the lower work area 18. This allows the worker 5 to access portions of the lower work area 18 directly under the worker 5 (e.g., under the worker's head), and optionally to access portions of the lower work area 18 that are located distally relative to the worker 5 (i.e., farther out away from the higher surface 14) that worker 5 might not otherwise be able to reach.

The adjustable support device 20 includes a main support assembly 22 and a leg support section 24 pivotally coupled to the main support assembly 22. The main support assembly 22 has a longitudinal axis 28 and a lateral axis 29. The main support assembly 22 includes a midsection support 30 and a chest support 40 slidably mounted to the midsection support 30 for movement along the longitudinal axis 28 relative to the midsection support 30. One or more suitable slides 42 are provided to slidably interconnect the chest support 40 to the midsection support 30. The slides 42 advantageously allow for sliding relative movement between the chest support 40 and the midsection support 30, while advantageously retaining the relative positions when a worker 5 is disposed on the adjustable support device 20. As can be seen in the figures, the chest support 40 is laterally narrower than the midsection support 30, and is disposed distally relative to the midsection support 30 so as to be opposite the leg support section 24. The midsection support 30 shown in FIGS. 2-6 is rectangular, with its longer dimension aligned with the longitudinal axis 28, but it should be understood that other shapes, such as hour-glass or otherwise contoured, are also contemplated.

The leg support section 24 is pivotally coupled to the main support assembly 22 for rotation about a first pivot axis 26 disposed parallel to the lateral axis 29. The leg support section 24 is disposed proximally (away from the lower work area 18) relative to the main support assembly 22. The leg support section 24 is pivotally coupled to the main support assembly by any suitable means, such as by one or more hinges 31 and/or a living hinge, or other means known in the art.

The adjustable support device 20 is movable between a first configuration, a second configuration, and a third configuration. In the first configuration, shown in FIG. 3, the leg support section 24, the midsection support 30, and the chest support 40 are disposed parallel to each other. Thus, in the first configuration, the adjustable support device 20 is flat. This first configuration is convenient for transport of the adjustable support device 20, and for initial placement of the adjustable support device 20 in the work area 10. In addition, in the first configuration, the chest support 40 is retracted toward the midsection support 30, and, in some aspects, is abutting the midsection support 30.

In the second configuration, shown in FIG. 4, the leg support section 24 is rotated about the first pivot axis 26 such that the leg support section 24 is angled upward relative to the midsection support 30, and the chest support 40 remains retracted toward the midsection support 30. In order to maintain the leg support section 24 in its angled position, the leg support section 24 includes one or more means for maintaining the leg support section 24 at an angle relative to the midsection support 30 when the midsection support 30 and the leg support section 24 are not parallel to one another. In some aspects, a strut 52 is provided on the underside of the leg support section 24. The strut 52 is rotatable between a retracted position parallel to the leg support section 24, and one or more deployed positions extending downward from the leg support section 24 at an angle. The free end of the strut 52, in some aspects, rests against the higher surface 14 to brace the leg support section 24 in its angled orientation. The angle of the strut 52 relative to the main portion of the leg support section 24 helps determine the angular orientation of the leg support section 24.

In the third configuration, shown in FIG. 5, the leg support section 24 is rotated about the first pivot axis 26 such that the leg support section 24 is angled upward relative to the midsection support 30, and the chest support 40 is extended away from the midsection support 30 along the longitudinal axis 28.

In some situations, it is desirable to allow the midsection support 30 to be angled relative to the higher surface 14, rather than parallel thereto, in order to provide more appropriate access to the lower work area 18. Accordingly, FIGS. 7-14 show an adjustable support device 20 that allows for such angling of the midsection support 30. Because the adjustable support device 20 of FIGS. 7-14 is similar to the adjustable support device 20 of FIGS. 2-6, with the addition of a frame 60, and the ability to angle the midsection support 30 (and thus the main support assembly 22) relative to the frame 60, the same reference numbers will be used to refer to the same parts.

The adjustable support device 20 of FIGS. 7-14 is intended for use in the work area 10; see for example, FIG. 7. In general, the adjustable support device 20 is positioned to provide ergonomic support for a worker 5 oriented facedown thereon, so that the worker 5 is supported in a cantilever fashion over the lower work area 18. This allows the worker 5 to access portions of the lower work area 18 directly under the worker 5 (e.g., under the worker's head), and optionally to access portions of the lower work area 18 that are located distally relative to the worker 5 (i.e., farther out away from the higher surface 14) that the worker 5 might not otherwise be able to reach.

The adjustable support device 20 includes a main support assembly 22, a leg support section 24 pivotally coupled to the main support assembly 22, and a frame 60. The main support assembly 22 has a longitudinal axis 28 and a lateral axis 29. The main support assembly 22 includes a midsection support 30 and a chest support 40 slidably mounted to the midsection support 30 for movement along the longitudinal axis 28 relative to the midsection support 30. One or more suitable slides 42 are provided to slidably interconnect the chest support 40 to the midsection support 30. The slides 42 advantageously allow for sliding relative movement between the chest support 40 and the midsection support 30, while advantageously retaining the relative positions when a worker 5 is disposed on the adjustable support device 20. As can be seen in the figures, the chest support 40 is laterally narrower than the midsection support 30, and is disposed distally relative to the midsection support 30 so as to be opposite the leg support section 24. The midsection support 30 shown in FIGS. 7-12 is rectangular in shape, with its longer dimension aligned with the longitudinal axis 28, but it should be understood that other shapes, such as hour-glass or otherwise contoured, are also contemplated.

The midsection support 30 includes a flange 32 that extends downwardly. The flange 32 includes a set 33 of holes 34, each hole 34 spaced from the neighboring hole(s) and configured to accept a pin 37 as described further below. In some aspects, the midsection support 30 has two flanges 32, one on each lateral side of the midsection support 30. Further, the midsection support 30, and therefore the main support assembly 22, is pivotally mounted to the frame 60, such as by one or more hinges 31 and/or a living hinge, or other means known in the art.

The leg support section 24 is pivotally coupled to the frame 60, and thus the main support assembly 22, for rotation about the first pivot axis 26, which is disposed parallel to the lateral axis 29. Thus, the frame 60 interconnects the leg support section 24 to the main support assembly 22. The leg support section 24 is disposed proximally (away from the lower work area 18) relative to the main support assembly 22.

The frame 60 is configured to support the main support assembly 22 and the leg support section 24, and has a proximal portion 61 and a distal portion 63. The frame 60 includes two longitudinal rails 66, with each longitudinal rail 66 extending from the proximal portion 61 to the distal portion 63. A proximal end rail 62 and a distal end rail 64 are provided, and the frame 60 is advantageously rectangular. A cross-rail 68 is provided and functionally divides the frame 60 into the proximal portion 61 and the distal portion 63. A center rail 72 extends between the proximal end rail 62 and the cross-rail 68. The center rail 72 includes a series of notches 74 that are configured to accept strut 52 mounted to the underside of leg support section 24. The frame 60 includes one or more wheels 82 attached to the proximal end rail 62 of the frame 60. In some aspects, two wheels 82 are mounted to the proximal end rail 62, one on each lateral side. The wheels 82 are positioned so as to not touch the higher surface 14 when the frame 60 is resting flat on the higher surface 14. The frame 60 includes one or more downwardly facing friction pads 80 disposed distally to the one or more wheels 82 and facing away from the midsection support 30. In some aspects, the two friction pads 80 are mounted to the underside of the proximal end rail 62, and optionally two friction pads 80 are mounted to the underside of the distal end rail 64. The friction pads 80 are intended to engage the higher surface 14 when the frame 60 is resting flat on the higher surface 14, and are of sufficient thickness to maintain the wheels 82 off the higher surface 14 when the frame 60 is resting flat on the higher surface 14. The frame 60 also advantageously includes one or more handles, such as a handle 69 disposed distally relative to the one or more wheels 82. In some aspects, the frame 60 includes a handle 69 disposed on the distal end rail 64 of the frame 60, opposite the one or more wheels 82, and/or a handle attached to a laterally outboard side of one or more of the longitudinal rails 66.

The main support assembly 22 is movably supported by the frame 60 so as to be rotatable relative thereto about the second pivot axis 39 disposed parallel to the lateral axis 29. An angle locking mechanism 35 connects the frame 60 to the midsection support 30. The angle locking mechanism 35 includes an arm 36 and a pin 37. The arm 36 is rotatably mounted to the frame 60, such as by being mounted to the inner side of longitudinal rail 66 in the distal portion 63, and is configured to accept pin 37. The pin 37 is insertable through a hole in the arm 36 (towards the free end of the arm) and into a selected hole 34 of the set 33 of holes on flange 32 of the midsection support 30 to releasably fix the arm 36 relative to the midsection support 30. In some aspects, there are two arms 36, one on each lateral side of the frame 60, and two pins 37. The pin 37 or pins are advantageously flexibly secured to the frame 60 by suitable cords (not shown).

The adjustable support device 20 of FIGS. 7-14 is movable between a first configuration, a second configuration, a third configuration, and a fourth configuration. In the first configuration, shown in FIG. 8, the leg support section 24, the midsection support 30, and the chest support 40 are disposed parallel to the frame 60, and thus parallel to each other. Thus, in the first configuration, the adjustable support device 20 is flat. This first configuration is convenient for transport of the adjustable support device 20, and for initial placement of the adjustable support device 20 in the work area 10. In addition, in the first configuration, the chest support 40 is retracted toward the midsection support 30, and, in some aspects, is abutting the midsection support 30.

In the second configuration, shown in FIG. 9, the leg support section 24 is rotated about the first pivot axis 26 such that the leg support section 24 is angled upward relative to the midsection support 30 and the chest support 40 remains retracted toward the midsection support 30. In order to maintain the leg support section 24 in its angled position, the leg support section 24 includes one or more means for maintaining the leg support section 24 at an angle relative to the midsection support 30 when the midsection support 30 and the leg support section 24 are not parallel to one another. In some aspects, strut 52 is pivoted so as to engage one of the notches 74 to releasably fix the leg support section 24 at the desired angle relative to the frame 60. The strut 52 is rotatable between a retracted position parallel to the leg support section 24, and one or more deployed positions extending downward from the leg support section 24 at an angle. The angle of the strut 52 relative to the main portion of the leg support section 24 helps determine the angular orientation of the leg support section 24.

In the third configuration, shown in FIG. 10, the leg support section 24 is rotated about the first pivot axis 26 such that the leg support section 24 is angled upward relative to the midsection support 30, and the chest support 40 is extended away from the midsection support 30 along the longitudinal axis 28. In the third configuration shown in FIG. 10, the chest support 40 is disposed distally beyond the frame 60.

In the fourth configuration, shown in FIG. 11, the leg support section 24 is rotated about the first pivot axis 26 such that the leg support section 24 is angled upward relative to the midsection support 30 and angled relative to the frame 60; the midsection support 30 is rotated about the second pivot axis 39 such that the midsection support 30 is angled upward relative to the frame 60; the chest support 40 is extended away from the midsection support 30 along the longitudinal axis 28.

The angling of the midsection support 30 is achieved by rotating the midsection support 30 relative to the frame 60 about an axis parallel to the lateral axis 29 (i.e., first pivot axis 26), and placing pins 37 through arms 36 and into corresponding selected holes 34 in the flanges 32 of the midsection support 30.

The midsection support 30, the chest support 40, and the leg support section 24 are, in some aspects, advantageously cushioned. Thus, the midsection support 30, the chest support 40, and the leg support section 24 are, in some aspects, formed of respective panels covered by suitable cushioning material and/or other protective layers.

A method of supporting a worker 5 for accessing a lower work area disposed lower than the worker 5, such as one that the worker 5 needs to extend out over in order to access appropriately advantageously employs the adjustable support device 20. In some aspects, the method includes disposing (step 110) the adjustable support device 20 on the higher surface 14 of the work area 10, near the lower work area 18. During this disposing (step 110) the adjustable support device 20 is typically in the first configuration. Thus, the adjustable support device 20 is typically flat. In some aspects, the disposing (step 110) the adjustable support device 20 includes placing one or more friction pads 80 of the adjustable support device 20 on the higher surface 14. Accordingly, the disposing (step 110) advantageously comprises positioning the adjustable support device 20 such that the one or more friction pads 80 are in contact with the higher surface 14 and the one or more wheels 82 are spaced from the higher surface 14 so as to not be in contact with the higher surface 14.

The method continues with changing (step 120) the adjustable support device 20 from the first configuration to the second configuration. The method continues with positioning (step 150) the worker 5 on the adjustable support device 20, in a facedown orientation (see FIGS. 6 and 12). Advantageously, the positioning (step 150) the worker is such that: 1) the worker's lower leg is supported by the leg support section 24 such that the worker's feet hang downward; 2) the worker's midsection is supported by the midsection support 30; 3) the worker's chest is supported by the chest support; and 4) a shoulder (or both) of the worker 5 is disposed laterally outboard of the chest support 40. Note that the chest of the worker 5 is supported by the chest support 40, and, in some aspects, the worker's chin rests on the chest support 40 as well. Note also that the worker's knees rest in the corner formed by the midsection support 30 and the leg support section 24.

In order to accommodate workers of various sizes, the adjustable support device 20 allows the chest support 40 to be slid in or out, as appropriate, to allow for the desired positioning of the worker 5 on the chest support 40. As such, in some aspects, the process includes adapting the adjustable support device 20 to better fit the worker 5. Thus, in some aspects, the method further includes, prior to the positioning (step 150) the worker 5, changing (step 130) the adjustable support device 20 to the third configuration. As noted above, in the third configuration, the leg support section 24 is rotated about the first pivot axis 26 such that the leg support section 24 is angled upward relative to the midsection support 30 and the chest support 40 is extended away from the midsection support 30 along the longitudinal axis 28. This configuration allows the worker 5 to be supported in a cantilever fashion over the lower work area 18 in a safe and ergonomic manner. Thus, the adjustable support device 20 is located on the higher surface 14, and provides a cantilever type support for the worker 5 to allow the worker 5 to access the lower work area 18, with the worker's chest, and optionally their head, supported by the chest support 40.

In some aspects, the method further includes, prior to the positioning (step 150) the worker 5, changing (step 140) the adjustable support device 20 to the fourth configuration by rotating the midsection support 30 relative to the frame 60, and securing the midsection support 30 in the desired angular position, such as by inserting pins 37 into the selected holes 44 in the flanges 32 of the midsection support 30.

In some aspects, the method further continues with the optional steps of, after the positioning (step 150) the worker 5 (and/or after the optional performing the task, see below), subsequently returning (step 170) the adjustable support device 20 to the first configuration for transport (away from the work area 10 or to another location in the work area 10), and moving (step 180) the adjustable support device 20 relative to the work area 10 while the adjustable support device 20 is in the first configuration. In some aspects, the moving (step 180) the adjustable support device 20 comprises rolling the adjustable support device 20 on one or more wheels 82 of the adjustable support device 20. The wheels 82, in some aspects, are mounted to the leg support section 24, or to a frame 60 of the adjustable support device 20. Note that if there are wheels 82, suitable friction pads 80 should be provided, with the friction pads 80 being sized and positioned so that the friction pads 80 extend downward more than the wheels 82 when the adjustable support device 20 is placed flat on the higher surface 14, so that the friction pads 80 engage the higher surface 14, and the wheels 82 do not, to help inhibit movement that may be possible if the wheels 82 engage the higher surface 14. Note that lifting the adjustable support device 20 (as shown in dashed lines in FIG. 14) by the distal end of the adjustable support device 20, opposite the leg support section 24, advantageously allows the wheels 82 to engage the higher surface 14, to facilitate rolling the adjustable support device 20.

In some aspects, the method(s) described above are advantageously used for manufacturing or servicing an aircraft, but other industrial applications are also intended, such as use in any factory. In some aspects, a method of manufacturing or servicing an aircraft is the same as described above (steps 110, 120, 150), optionally including optional steps 130, 140, 170, and 180, but adds a step of a worker 5 performing (step 160) a task in the lower work area while the worker 5 is supported on the adjustable support device 20 in a facedown orientation, such that: 1) the worker's lower leg is supported by the leg support section 24 such that the worker's feet hang downward; 2) the worker's midsection is supported by the midsection support 30; 3) the worker's chest is supported by the chest support; and 4) a shoulder (or both) of the worker 5 is disposed laterally outboard of the chest support 40. In some aspects, the task is at least one of: installing a component 19 of the aircraft in the lower work area; removing a component 19 of the aircraft from the lower work area; replacing a component 19 of the aircraft in the lower work area; inspecting a component 19 of the aircraft disposed in the lower work area; and/or drilling and/or reaming in the lower work area. Note that because the chest support 40 is narrower than the midsection support 30, the positioning of the worker's shoulder laterally outboard the chest support 40 allows the worker 5 to have a full range of motion of the worker's arms for working in the lower work area 18. Thus, the narrower chest support 40 makes performing the task easier.

The various portions of the adjustable support device 20 are made from any suitable materials, such as aluminum, steel, plastic (with or without reinforcement), etc. The materials chosen should be strong enough to support the worker 5 with suitable safety margin.

For clarity in understanding the present disclosure, to the extent that "at least one of" a conjunctive list of items is discussed (and similarly for "one or more of" such a list), the present disclosure refers to any item in the list or any combination of the items in the list (e.g., an A only, or three A's, or a B only, or both an A and a B, or two A's and three B's, etc.). Such a phrase does not require at least one of each of the items in the list (e.g., at least one of A and at least one of B).

The present disclosure may, of course, be carried out in other ways than those specifically set forth herein without departing from essential characteristics of the disclosure. The present embodiments are to be considered in all respects as illustrative and not restrictive, and all changes coming within the meaning and equivalency range of the appended claims are intended to be embraced therein.

What is claimed is:

1. An adjustable support device for providing support to a worker oriented facedown thereon for accessing a lower work area disposed lower than the worker, the adjustable support device comprising:

a main support assembly having a longitudinal axis and a lateral axis; the main support assembly comprising a midsection support and a chest support slidably mounted to the midsection support for movement along the longitudinal axis relative to the midsection support;

a leg support section pivotally coupled to the main support assembly for rotation about a first pivot axis disposed parallel to the lateral axis;

wherein the chest support is laterally narrower than the midsection support;

wherein the adjustable support device is movable between a first configuration, a second configuration, and a third configuration;

wherein, in the first configuration:

the leg support section, the midsection support, and the chest support are disposed parallel to each other; and the chest support is retracted toward the midsection support;

wherein, in the second configuration:

the leg support section is rotated about the first pivot axis such that the leg support section is angled upward relative to the midsection support; and the chest support is retracted toward the midsection support;

wherein, in the third configuration:

the leg support section is rotated about the first pivot axis such that the leg support section is angled upward relative to the midsection support; and the chest support is extended distally away from the midsection support along the longitudinal axis;

a frame configured to support the main support assembly and the leg support section;

a pair of wheels mounted to the frame, one on each lateral side thereof, so as to extend laterally farther than the frame;

a pair of downwardly facing friction pads immovably mounted to the frame at respective fixed locations on lateral portions thereof near a corresponding wheel of the pair of wheels; wherein the friction pads have a thickness sufficient to extend downwardly away from the frame farther than the wheels;

wherein the adjustable support device is configured such that:

when the adjustable support device is resting on a surface with the frame parallel to the surface:

the friction pads abut the work surface;

the wheels are spaced from the work surface;

the frame can be angled upward relative to the surface such that:

the friction pads are spaced from the work surface;

the wheels rollingly engage the work surface.

2. The adjustable support device of claim 1:

wherein the leg support section is pivotally mounted to the frame, and the frame interconnects the leg support section to the main support assembly; and wherein, in the third configuration, the chest support is disposed distally beyond the frame.

3. The adjustable support device of claim 1:

wherein the frame comprises a proximal end rail disposed transverse to the longitudinal axis;

wherein the wheels are mounted to the proximal end rail of the frame.

4. The adjustable support device of claim 3, wherein the friction pads are mounted to the proximal end rail of the frame.

5. The adjustable support device of claim 1 wherein the frame comprises a handle disposed distally relative to the wheels.

6. The adjustable support device of claim 1, wherein the friction pads are disposed so as to longitudinally overlap the corresponding wheel.

7. The adjustable support device of claim 2, wherein the main support assembly is movably supported by the frame so as to be rotatable relative thereto about a second pivot axis disposed parallel to the lateral axis.

8. The adjustable support device of claim 7:

wherein the adjustable support device is movable to a fourth configuration;

wherein, in the fourth configuration:

the leg support section is rotated about the first pivot axis such that the leg support section is angled upward relative to the midsection support and angled relative to the frame;

the midsection support is rotated about the second pivot axis such that the midsection support is angled upward relative to the frame; and the chest support is extended away from the midsection support along the longitudinal axis.

9. The adjustable support device of claim 8, further comprising an angle locking mechanism connecting the frame to the midsection support, wherein the angle locking mechanism comprises an arm and a pin; the arm rotatably mounted to the frame; wherein the pin is insertable through a hole in the arm and into a selected hole of a set of holes on a flange of the midsection support to releasably fix the arm relative to the midsection support.

10. The adjustable support device of claim 3:

wherein the frame comprises a distal end rail disposed transverse to the longitudinal axis and longitudinally spaced from the proximal end rail;

wherein a second pair of downwardly facing friction pads are immovably mounted to the distal end rail.

11. A method of supporting a worker for accessing a lower work area disposed lower than the worker, the method comprising:

disposing an adjustable support device on a higher surface of a work area, near the lower work area; wherein the adjustable support device is movable between a first configuration, a second configuration, and a third configuration; wherein the adjustable support device comprises:

a main support assembly having a longitudinal axis and a lateral axis; the main support assembly comprising a midsection support and a chest support slidably mounted to the midsection support for movement along the longitudinal axis relative to the midsection support;

a leg support section pivotally coupled to the main support assembly for rotation about a first pivot axis disposed parallel to the lateral axis;

a frame configured to support the main support assembly and the leg support section;

a pair of wheels mounted to the frame, one on each lateral side thereof, so as to extend laterally farther than the frame;

a pair of downwardly facing friction pads immovably mounted to the frame at respective fixed locations on lateral portions thereof near a corresponding wheel of the pair of wheels; wherein the friction pads have a thickness sufficient to extend downwardly away from the frame farther than the wheels;

wherein the adjustable support device is configured such that:

when the adjustable support device is resting on a surface with the frame parallel to the surface:

the friction pads abut the work surface;

the wheels are spaced from the work surface;

the frame can be angled upward relative to the surface such that:

the friction pads are spaced from the work surface;

the wheels rollingly engage the work surface;

wherein the chest support is laterally narrower than the midsection support;

wherein, in the first configuration:

the leg support section, the midsection support, and the chest support are disposed parallel to each other; and the chest support is retracted toward the midsection support;

wherein, in the second configuration:

the leg support section is rotated about the first pivot axis such that the leg support section is angled upward relative to the midsection support; and the chest support is retracted toward the midsection support;

wherein, in the third configuration:

the leg support section is rotated about the first pivot axis such that the leg support section is angled upward relative to the midsection support; and the chest support is extended distally away from the midsection support along the longitudinal axis;

changing the adjustable support device from the first configuration to the second configuration;

positioning the worker on the adjustable support device in a facedown orientation, such that:

the worker extends out over the lower work area;

the worker's lower leg is supported by the leg support section such that the worker's feet hang downward;

the worker's midsection is supported by the midsection support;

the worker's chest is supported by the chest support; and a shoulder of the worker is disposed laterally outboard of the chest support.

12. The method of claim 11, further comprising, prior to the positioning the worker, changing the adjustable support device to the third configuration.

13. The method of claim 11:

wherein, in the first configuration, the leg support section, the midsection support, and the chest support are disposed parallel to the frame.

14. The method of claim 13, further comprising:

subsequently returning the adjustable support device to the first configuration for transport; and moving the adjustable support device relative to the work area while the adjustable support device is in the first configuration.

15. The method of claim 14, wherein the moving the adjustable support device comprises rolling the adjustable support device on the pair of wheels of the adjustable support device.

16. The method of claim 11:

wherein the main support assembly is movably supported by the frame so as to be rotatable relative thereto about a second pivot axis disposed parallel to the lateral axis;

further comprising, prior to the positioning the worker, changing the adjustable support device to a fourth configuration; wherein, in the fourth configuration:

the leg support section is rotated about the first pivot axis such that the leg support section is angled upward relative to the midsection support and angled relative to the frame;

the midsection support is rotated about the second pivot axis such that the midsection support is angled upward relative to the frame; and the chest support is extended away from the midsection support along the longitudinal axis.

17. The method of claim 11, wherein the disposing the adjustable support device comprises placing the friction pads of the adjustable support device on the higher surface.

18. The method of claim 11:

wherein the disposing comprises positioning the adjustable support device such that the friction pads are in contact with the higher surface and the one or more wheels are spaced from the higher surface so as to not be in contact with the higher surface.

19. A method of manufacturing or servicing an aircraft, the method comprising:

disposing an adjustable support device on a higher surface of a work area, near the lower work area; wherein the adjustable support device is movable between a first configuration, a second configuration, and a third configuration; wherein the adjustable support device comprises:

a main support assembly having a longitudinal axis and a lateral axis; the main support assembly comprising a midsection support and a chest support slidably mounted to the midsection support for movement along the longitudinal axis relative to the midsection support;

a leg support section pivotally coupled to the main support assembly for rotation about a first pivot axis disposed parallel to the lateral axis;

a frame configured to support the main support assembly and the leg support section;

a pair of wheels mounted to the frame, one on each lateral side thereof, so as to extend laterally farther than the frame;

a pair of downwardly facing friction pads immovably mounted to the frame at respective fixed locations on lateral portions thereof near a corresponding wheel of the pair of wheels; wherein the friction pads have a thickness sufficient to extend downwardly away from the frame farther than the wheels;

wherein the adjustable support device is configured such that:

when the adjustable support device is resting on a surface with the frame parallel to the surface:

the friction pads abut the work surface;

the wheels are spaced from the work surface;

the frame can be angled upward relative to the surface such that:

the friction pads are spaced from the work surface;

the wheels rollingly engage the work surface;

wherein the chest support is laterally narrower than the midsection support;

wherein, in the first configuration:

the leg support section, the midsection support, and the chest support are disposed parallel to each other; and the chest support is retracted toward the midsection support;

wherein, in the second configuration:

the leg support section is rotated about the first pivot axis such that the leg support section is angled upward relative to the midsection support; and the chest support is retracted toward the midsection support;

wherein, in the third configuration:

the leg support section is rotated about the first pivot axis such that the leg support section is angled upward relative to the midsection support; and the chest support is extended distally away from the midsection support along the longitudinal axis;

changing the adjustable support device from the first configuration to the second configuration;

positioning a worker on the adjustable support device in a facedown orientation so that the worker extends out over the lower work area;

the worker performing a task in the lower work area while the worker is supported on the adjustable support device in a facedown orientation, such that:

the worker's lower leg is supported by the leg support section such that the worker's feet hang downward; and the worker's midsection is supported by the midsection support;

the worker's chest is supported by the chest support; and a shoulder of the worker is disposed laterally outboard of the chest support.

20. The method of claim 19, wherein the task is at least one of:

installing a component of the aircraft in the lower work area;

removing a component of the aircraft from the lower work area;

replacing a component of the aircraft in the lower work area;

inspecting a component of the aircraft disposed in the lower work area; and/or drilling and/or reaming in the lower work area.

* * * * *